United States Patent [19]

Trambouze et al.

[11] Patent Number: 4,816,140

[45] Date of Patent: Mar. 28, 1989

[54] PROCESS FOR DEASPHALTING A HYDROCARBON OIL

[75] Inventors: Pierre Trambouze, Caluire; Jean Paul Euzen, Dardilly; Pierre Bergez, Paris; Michel Claveau, Fresnes, all of France

[73] Assignees: Institut Francais du Petrole, Rueil-Malmaison; Commissariat a l'Energie Atomique, Paris, both of France

[21] Appl. No.: 32,699

[22] Filed: Apr. 1, 1987

[30] Foreign Application Priority Data

Apr. 2, 1986 [FR] France ..... 86 04827

[51] Int. Cl.[4] ..... C10L 3/00

[52] U.S. Cl. ..... 208/309; 208/45; 585/818

[58] Field of Search ..... 208/309; 585/818

[56] References Cited

U.S. PATENT DOCUMENTS

| | | | |
|---|---|---|---|
| Re. 27,888 | 1/1974 | Li | 585/818 |
| 2,940,920 | 6/1960 | Garwin | 208/86 |
| 3,305,595 | 2/1967 | Paulson | 208/309 |
| 3,930,990 | 1/1976 | Brun et al. | 585/818 |
| 4,239,616 | 12/1980 | Gearhart | 208/381 |
| 4,305,814 | 12/1981 | Leonard | 208/45 |
| 4,368,112 | 1/1983 | Thompson et al. | 208/321 |
| 4,411,790 | 10/1983 | Arocl et al. | 208/309 |
| 4,496,456 | 1/1985 | Halfez et al. | 208/33 |
| 4,510,047 | 4/1985 | Thompson | 585/818 |
| 4,532,041 | 7/1985 | Shuey et al. | 585/818 |
| 4,648,962 | 3/1987 | Ceepes et al. | 208/177 |

*Primary Examiner*—H. M. S. Sneed
*Assistant Examiner*—Helane Myers
*Attorney, Agent, or Firm*—Millen & White

[57] ABSTRACT

For deasphalting an asphaltene-containing hydrocarbon oil, employed is a hydrocarbon solvent of 3–8 carbon atoms, resulting in an asphaltic phase and a solution of deasphalted oil in the solvent. The solvent is then separated from the deasphalted oil, by passing the solution tangentially across an inorganic membrane of pore radii from 2 to 15 nonometers: the obtained filtrate has an increased solvent content and may be recycled. The deasphalted oil is selectively retained on the upstream side of the membrane.

10 Claims, 1 Drawing Sheet

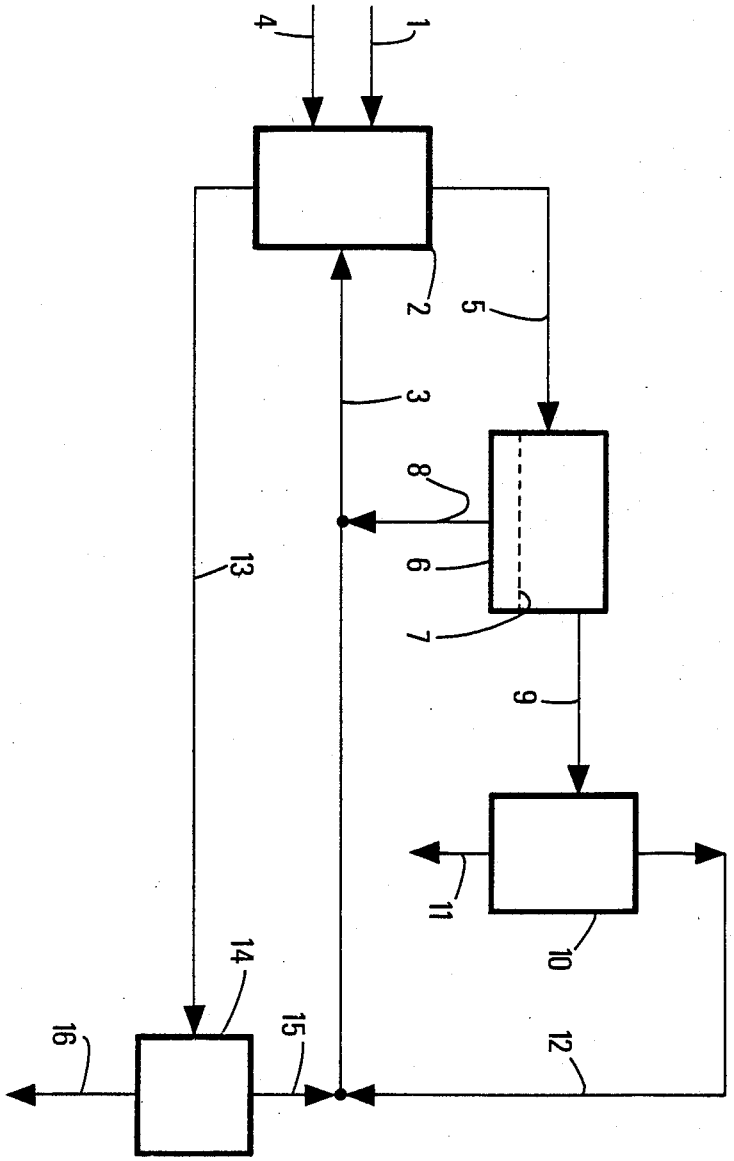
1
2
3
4
5
6
7
8
9
10
11
12
13
14
15
16

PROCESS FOR DEASPHALTING A HYDROCARBON OIL

The present invention relates to a process for deasphalting a hydrocarbon oil, and separating, the deasphalted, hudrocarbon oil from the deasphalting solvent.

BACKGROUND OF THE INVENTION

A large number of hydrocarbon charges used in the oil industry, such as certain crude oils, straight-run residues or vacuum residues, shale or bituminous sand oils, or products from coal liquefaction, are characterized by a high content of asphaltenes and of such metals as nickel and vanadium; accordingly, they cannot be directly subjected to the conventional refining treatment such as catalytic cracking, hydrocracking or hydrodesulfurization, for example.

As a matter of fact, the metals and an asphaltenic carbon fraction remain fixed onto the catalyst, obstructing the pores, destroying the activity of the active centers and generating pressure drops. As a result, the catalyst charge must be renewed at a more frequent rate as the metal and asphaltene contents are higher. It is thus convenient to divide the asphaltenic charge into two fractions: a fraction essentially formed of asphaltenes and containing the major part of the metals and a complementary fraction formed of deasphalted oil. The more currently used separation technique, disclosed in the prior art, is the precipitation of asphaltenes by addition to the asphaltenic oil of suitable amounts of light hydrocarbons under convenient conditions. For the purpose of selectively precipitating asphaltenes, the selected solvents consist of light hydrocarbons, paraffinic or olefinic, preferably containing 3 to 8 carbon atoms, used either pure or preferably as mixture.

This deasphalting operation must be achieved as selectively as possible in order to obtain a maximum yield of deasphalted oil. The yield of deasphalted oil obiviously depends on the asphaltene content of the treated charge and on the nature of the asphaltenes. The selectivity of the operation depends on the operating conditions of temperature, pressure, residence time in the separation vessel, but it mainly depends on the nature of the precipitation solvent and on the solvent-to-charge ratio. For efficiency, this operation involves the use of a large volume of solvent since the ratio by volume of the solvent to the charge generally ranges from 2/1 to 15/1 and mostly from 3/1 to 8/1.

The more commonly used apparatuses for this operation consist of:

either an extractor-settler from the bottom of which are recovered the coagulated asphalts together with a small fraction, generally from about 5 to 15%, of the solvent.

From the top of the extractor-settler is recovered a mixture of hydrocarbon oil, free of asphalts, forming the so-called "deasphalted oil", together with the major part—usually about 85–95%—of the solvent used in this operation.

or in a multistage column: the charge is introduced into the upper half part of the column, the solvent being fed counter-currently to the column bottom. Asphalt is recovered from the bottom and the mixture of deasphalted oil and solvent is recovered from the heated top.

According to the nature of the solvent, this mixture is recovered at a temperature usually ranging from 60° to 220° C., under such a pressure that the solvent and the deasphalted oil mixture remain in liquid state. The deasphalted oil content of this mixture, extracted from the top, obviously depends on the nature of the charge and on the amount of solvent used in proportion to the charge as well as on the operating conditions. Generally, the proportion by weight of deasphalted oil in this top fraction is from 10 to 40% and mostly from 20 to 38%.

The treatment of this fraction consisting of separating the solvent from the deasphalted oil is theoretically simple in view of the respective different volatilities of the constituents. As a matter of fact, the deasphalted oil boils under normal pressure within a temperature range far aove 350° C.; however the solvent evaporation requires a considerable power expense in view of the large amount of solvent used.

Accordingly, many processes for solvent evaporation tending to decrease the power expense have been disclosed in the prior art, such for example as in U.S. Pat. No. 2,943,050 disclosing a process using successively two flash eveporators, French Pat. No. 2,425,472 disclosing a process using three continuous flash distillation zones operating under constant temperature and pressure conditions, French Pat. No. 2,490,103 claiming a process for recovering solvent in several steps, in falling-film evaporators providing also for a nucleate boiling. Some of these processes provide for about 50% reduction of the power expense of the operation, but nevertheless the corresponding cost remains high.

Another process for reducing the power cost consists of heating the deasphalted oil and solvent mixture to a temperature higher than the critical temperature of the solvent. Under these supercritical conditions, the solubility of the deasphalted oil in the solvent decreases and a separation of the two phases occurs. This technique has been disclosed in many patents and paper, such as U.S. Pat. Nos. 2,940,920, 4,239,616, 4,290,880 and 4,305,814.

However, although it is true that this process provides for substantial power saving during the step of recovering the deasphalting solvent, it suffers from the disadvantage of requiring higher temperature and pressure conditions than those used in the conventional solvent recovery and of requiring an extensive thermal exchange between the deasphalted oil-deasphalting solvent mixture and the separated deasphalting solvent.

The purpose of the present invention is to provide a new deasphalting process comprising a step of separating the deasphalted oil from the deasphalting solvent by ultrafiltration, in the liquid phase, without change of state, this separation being conducted at high temperature and resulting in substantial power saving as compared with the prior art processes.

The use of organic semipermeable membranes in processes for separating various compounds is well known; such processes are usually called "reverse osmosis" or "ultrafiltration" processes. These membranes usually consist of polymer materials such as cellulose esters, regenerated cellulose, polyamides, polyvinyl chloride or cross-linked polyethylene, polyacrylonitrile and polysulfone.

Their use in petrochemistry is considerably limited by their poor resistance to hydrocarbon solvents and their very low thermal stability.

The French Pat. No. 2,482,975 illustrates for prior art ultrafiltration processes using inorganic membranes for separating hydrocarbon products in the liquid state at a temperature higher than 80° C. This patent states the use of inorganic ultrafiltration barriers coated with a sensitive layer of at least one metal oxide having a permeametry radius ranging from 50 to 250 Å; it is adapted to the regeneration of used oils by removing their impurities which are retained by the barriers and it may also be used to reduce the asphaltene content of the hydrocarbon charges. For this latter application, the process appears to be unsatisfactory since the rate of removal of asphaltenes is still low, as shown in example 2 of said French patent.

OBJECTS OF THE INVENTION

One object of the invention is to provide a deasphalting process coping with the disadvantages of the prior art processes. Another object is to provide a process saving power, by at least partly avoiding the distillation and which, in addition, is selective.

According to this process, the deasphalted oil is separated from the deasphalting solvent in the liquid phase, without change of state, at a temperature generally higher than 80° C., this process resulting in a substantial power saving as compared with the prior art processes.

According to this process, the purified oil is selectively retained by an inorganic porous ultrafiltration membrane whereas the solvent passes through said membrane.

SUMMARY OF THE INVENTION

More precisely, the process of the invention is characterized by the steps of:

(a) treating the oil with at least one hydrocarbon solvent having 3 to 8 carbon atoms under deasphalting conditions resulting in the formation of two phases, a first phase consisting of a mixture of deasphalted oil with solvent and a second phase of high asphaltene content, these two phases being separated.

(b) circulating the first phase of deasphalted oil and solvent, in liquid phase, along at least one inorganic ultrafiltration membrane of pore radii selected from 2 to 15 nanometers (20 to 150 Å) at a temperature of at least 80° C., for example 80°–400° C., under ultrafiltration conditions, and separately recovering the ultrafiltrate, of increased solvent content and an unfiltered residual phase or retained fraction, of increased deasphalted oil content, which constitutes the main product of the process, and (c) feeding back the ultrafiltrate to step (a) as a part of the hydrocarbon solvent having 3 to 8 carbon atoms.

Preferably, the pore radii of the organic membrane will be from 4 to 9 nanometers.

The ultrafiltration porous membrane may be any one of those disclosed in the prior art and, for example, in U.S. Pat. Nos. 4,060,488 or 4,411,790 or in French Pat. No. 2,550,953.

In particular, the membrane may comprise a porous carrier of carbon, metal, ceramic or equivalent, whereon has been deposited a fine inorganic substance, for example one of the oxides of the following elements: titanium, zirconium, magnesium, silicium, aluminum, yttrium, hafnium, boron, mixed oxides of several of these elements, or an alkali or alkaline-earth metal fluoride, a silicium carbide, a silicium nitride, etc.

The inorganic membranes used according to the invention may operate up to temperatures of 350° to 400° C. without loss in their separation efficiency since their pore texture is stable in these thermal conditions. Moreover, in this temperature range, these inorganic membranes may operate with upstream-downstream pressure differences which may easily reach 25 bars.

The circulation velocity along the membrane is for example from 0.5 to 20 m/s, preferably 1 to 10 m/s in order to still improve the selectivity, which improvement is due to the formation of a concentration polarization layer of the heavier molecules on the ultrafiltration layer.

The ultrafiltration step (b) is preferably continued until the solvent content of the mixture of deasphalted oil with the solvent having circulated along the membrane, in contact therewith but having resisted to the filtration and hence being maintained on the upstream side of the membrane, be reduced to 1–50%, preferably 2–30% of the solvent content of said mixture of deasphalted oil and solvent before filtration, said mixture of decreased solvent content being then subjected to a distillation for separating at least a portion of the residual solvent.

When steps (a) and (b) are performed under the same pressure or only sightly different pressures, the ultrafiltration treatment is advantagrously conducted at a temperature 2° to 50° C. lower than the temperature of the first phase of deasphalted oil and solvent, at the end of step (a). Independently from this indication, the temperature may, for example, range from 80° to 220° C.; the temperature and the pressure are usefully selected so as to maintain the first phase of deasphalted oil and solvent in a completely liquid state, at least on the upstream side of the membrane. The pressure must obviously be higher on the upstream side than on the downstream side of the membrane.

According to the type of application of the process, a variable number of membranes may be grouped in ultrafiltration elementary units, these units being arranged either in series or in parallel. The number of these units obviously depends on the selectivity of the ultrafiltration membranes, on the nature of the charge and on the extent of the desired enrichment for the two fractions.

The charges to be treated by the process of the invention are those which are recovered at the top of the extractors of conventional solvent-deasphalting units. All the hydrocarbon charges of various origins having as asphaltene content (determined by precipitation with n-heptane) higher than 0.2% by weight are subjected to the deasphalting operation. These charges may have been subjected optionally to thermal pretreatments such for example as visbreaking or hydrovisbreaking.

The deasphalting solvents used in these operations are light hydrocarbons, paraffinic or olefinic, preferably comprising from 3 to 8 carbon atoms, used either pure or as mixture. More specifically, for sake of economy, such hydrocarbon cuts as propane cut, butane cut, mixture of butane cut with propane cut, pentane cut, and optionally the so-called "light gasoline" cut, mainly consisting of mixtures of aliphatic $C_5$ and $C_6$ hydrocarbons, are used.

The mixture of deasphalted oil with the deasphalting solvent recovered at the output of a conventional deasphalting unit is mostly, depending on the nature of the solvent, at a temperature from 60° to 220° C. and under a pressure from 30 to 45 bars; for example for $C_5$ and $C_5$–$C_6$ cuts, the temperature of the mixture is usually from 170° to 220° C. and the pressure of about 30–40 bars. Such a mixture may thus be supplied to the ultrafiltration units in the same temperature and pressure conditions, which constitutes an advantage of the process.

The membranes, when they have the above-defined pore texture, may operate over a long time without detrimental loss of filtration power. However, in order to clean the filter it may be convenient to periodically apply on the downstream side a higher pressure than on the upstream side. The filters described in U.S. Pat. No. 4,411,790 and French Pat. No. 2,550,953 have the advantage of being adapted to this operation.

BRIEF DESCRIPTION OF THE DRAWING

The FIGURE of the accompanying drawing is a flow-sheet illustrating a particular embodiment of the process according to the invention. On this FIGURE the ultrafiltration elementary units have been shown, for sake of simplicity, as an ultrafiltration assembly (6) wherein the ultrafiltration membranes are indicated by reference (7).

The charge to be deasphalted is introduced continuously into the extractor (2) through line (1), the fresh desaphalting solvent being introduced into the extractor through line (4) and the recycled solvent through line (3).

The mixture of deasphalted oil with the deasphalting solvent is recovered at the top of the extractor through line (5); this mixture is introduced into the ultrafiltration assembly (6), wherefrom are withdrawn:

through line (8), the ultrafiltrate, consisting of a mixture of high solvent content, which is recycled through line (3) towards the extractor-deasphaltor (2);

through line 9, the unfiltered or retained fraction, consisting of a mixture of high deasphalted oil content, which is fed to a flash evaporator (10) for the removal of the remaining solvent. The deasphalted oil, free of solvent, is recovered through line (11) at the output of evaporator (10).

The vaporized solvent is discharged from evaporator (10) through line (12) and recycled towards extractor (2).

The coagulated asphalts, together with a small part of the deasphalting solvent, are recovered from the bottom of extractor (2), through line (13).

This asphaltic fraction may be treated by conventional means, not shown on the FIGURE; for example this fraction may be subjected to evaporation in evaporator (14), so as to remove the major part of the solvent, and then stripped with steam for removing the last solvent fractions in a unit therefor, not shown on the FIGURE. The solvent recovered during these operations will be recycled to deasphaltor (2) through line (15). Asphalt is withdrawn through line (16).

EXAMPLE

The following example is given to illustrate the invention and must not be considered as limiting the scope thereof.

A Safaniya vacuum residue is deasphalted by addition of pentane. The operation is conducted with a solvent-/oil volume ratio of about 3/1 to 4/1 at 180° C. under a pressure of 4 MPa. Two phases separate. The asphaltic phase is discharged. The oil phase, which contains about 23% by weight of solvent, is circulated along membranes of aluminum oxide of 4.5 nm pore radii (tangential ultrafiltration). The pressure is 40 bars upstream and 32 bars downstream the membranes and the temperature 180° C. The circulation velocity along the membrane is 3.5 m/s.

The fraction which has not passed through filters, consisting of deasphalted oil still containing 10% of solvent, is recovered. The solvent is separated by evaporation in a falling-film evaporator, from the desired deasphalted oil. The filtrate, formed of solvent with a few oil (less than 5%) is fed back to the deasphalting zone; the fresh solvent addition is consequently reduced so as to maintain a ratio from 3/1 to 4/1 between the solvent and the oil to be deasphalted.

The yield to deasphalted oil is 68%.

The characteristics of the charge and of the obtained oil are given hereinafter:

| | Charge | Deasphalted oil |
|---|---|---|
| $C_7$ asphaltenes (Standard AFNOR NFT 60115) (% by weight) | 13 | 0.05 |
| $C_5$ asphaltenes (% by weight) | 24 | 0.3 |
| Conradson carbon (% by weight) | 23 | 11.2 |
| Sulfur (% by weight) | 5.3 | 4.5 |

What is claimed as the invention is:

1. A process for deasphalting an asphaltene-containing hydrocarbon oil, comprising the steps of:

(a) treating the oil with at least one paraffinic or olefinic hydrocarbon solvent having 3–8 carbon atoms, under deasphalting conditions resulting in the formation of two phases, a first phase consisting of a mixture of deasphalted oil and solvent and a second phase of high asphaltene content, and separating these two phases:

(b) passing the first phase of deasphalted oil and solvent, in a liquid state, across at least one solid inorganic ultrafiltration membrane of pore radii selected in the range from 2 to 15 nanometers at a temperature of at least 80° C., under tangential ultrafiltration conditions, and separately recovering the ultrafiltrate, of increased solvent content, and a residual unfiltered retained phase of increased deasphalted oil content, forming the main product of the process, and (c) recycling the ultrafiltrate to step (a) as at least a part of the hydrocarbon solvent having 3–8 carbon atoms.

2. A process according to claim 1, wherein the pore radii range from 4 to 9 nanometers.

3. A process according to claim 1, wherein the ultrafiltration treatment of step (b) is continued until the solvent content of the unfiltered residual phase be decreased to 1–50% of the solvent content of the first phase of deasphalted oil and solvent recovered in step (a) and subjected to ultrafiltration, and the resulting residual unfiltered phase is then subjected to distillation in order to separate at least a portion of the residual solvent therefrom.

4. A process according to claim 1, wherein the ultrafiltration is conducted at a temperature 2°–50° C. lower than the temperature of the deasphalted oil and solvent phase at the end of the deasphalting operation of step (a).

5. A process according to claim 1, wherein the pressure and the temperature of the ultrafiltration operation are so selected as to maintain the deasphalted oil and solvent phase completely in liquid state, at least on the upstream side of the membrane.

6. A process according to claim 3, wherein the ultrafiltration treatment of step (b) is continued until the solvent content of the residual unfiltered phase be decreased to 2–30% of the solvent content of the first phase of deasphalted oil and solvent.

7. A process according to claim 1, wherein the temperature in step (b) is from 80° to 400° C.

8. A process according to claim 1 wherein the circulation velocity along the membrane is from 0.5 to 20 m/s.

9. A process according to claim 1, wherein the membrane is made of aluminum oxide.

10. A process according to claim 1 wherein the inorganic membrane comprises a porous carbon, metal, or ceramic carrier coated with a deposit of at least one oxide of titanium, zirconium, magnesium, silicium, aluminum, yttrium, hafnium or boron, or an alkaline earth metal fluoride, or silicon carbide or nitride.

* * * * *